US005211189A

United States Patent [19]

Santarossa

[11] Patent Number: 5,211,189

[45] Date of Patent: May 18, 1993

[54] DISHWASHER WITH REMOVABLE RACK

[75] Inventor: Gianni Santarossa, Porcia, Italy

[73] Assignee: Zanussi Elettrodomestici S.P.A., Pordenone, Italy

[21] Appl. No.: 806,650

[22] Filed: Dec. 13, 1991

[30] Foreign Application Priority Data

Dec. 17, 1990 [IT] Italy ..... 34095/90[U]

[51] Int. Cl.[5] ..... A47L 15/23

[52] U.S. Cl. ..... 134/179; 134/180

[58] Field of Search ..... 134/144, 148, 172, 176, 134/179, 180, 181, 200

[56] References Cited

U.S. PATENT DOCUMENTS 3,375,835 4/1968 Lopp et al. ..... 134/176

3,989,054 11/1976 Mercer ..... 134/176 X 4,266,565 5/1981 Gurubatham ..... 134/176 X

*Primary Examiner*—Philip R. Coe

*Attorney, Agent, or Firm*—Pearne, Gordon, McCoy & Granger

[57] ABSTRACT

A dishwasher with a wash tub (4) with a removable rack (3) under which there is inserted a rotor (8) which is designed to be fed through a connection duct with rotating hydraulic joint extending upward from the bottom of the tub. The bottom of the rack (3) has several crosspieces (18), at least one of which has an angular, downward bend at the center (19), axially aligned with the rotor (8) and adjacent to it when the rack is in place in the tub (4) to limit the upward movement of the rotor (8).

4 Claims, 2 Drawing Sheets

DISHWASHER WITH REMOVABLE RACK

The invention relates to a dishwasher equipped with a tub able to contain at least one removable rack to support the articles to be washed.

DESCRIPTION OF RELATED ART

As is known, dishwashers normally house a lower and an upper rack in the washing tub under which there are the respective rotors suitable for spraying the dishes to be washed. A dishwasher of this type is described, for example, in GB-A-1 514 652. The lower rotor in particular is connected to the force or pressurized duct of a circulation pump by means of a rotating hydraulic joint having a connection duct extending upward from the bottom of the tub. To prevent the rotors disconnection from its rotating joint due to the high hydraulic pressure exerted by the circulation pump during pump start-up, the rotor has two means of restraining its upward axial movement. Such means of restraint can be made, for example of a pair, by flexible stirrups going from the rotor downward and ending with their respective cogs designed to hook loosely onto a striker ring placed externally on the connection duct. However, the flexible stirrups undesirably complicate the rotor structure and can cause friction with the connection tube which hinders the rotation of the rotor.

Alternatively, the means of restraint can consist of a striker plate placed in a fixed position above the rotor by means of a vertical support rod which extends along the connection duct and across the rotor. However, this solution also proves to be undesirably complex in construction and, what is more, it is necessary for the plate to be removed before the rotor can be taken out for maintenance.

SUMMARY OF THE INVENTION

The purpose of the present invention is to provide a dishwasher with at least one removable rack and associated rotor fitted with particularly simple means to limit the axial movement during operation and to make simple and handy removal possible whenever the rack is taken out.

According to the invention, this aim is attained in a dishwasher having a removable rack which includes a downwardly extending stop. The stop is in axial alignment with the rotor and adjacent to the rotor when installed within the tub to prevent or limit upward movement of the rotor.

BRIEF DESCRIPTION OF THE DRAWINGS

The characteristics and advantages of the invention will be clarified by the following description, intended only as a non-limiting example, reference being made to the attached drawings, in which.

DETAILED DESCRIPTION OF THE PREFERRED EMBODIMENT

Figure 1:
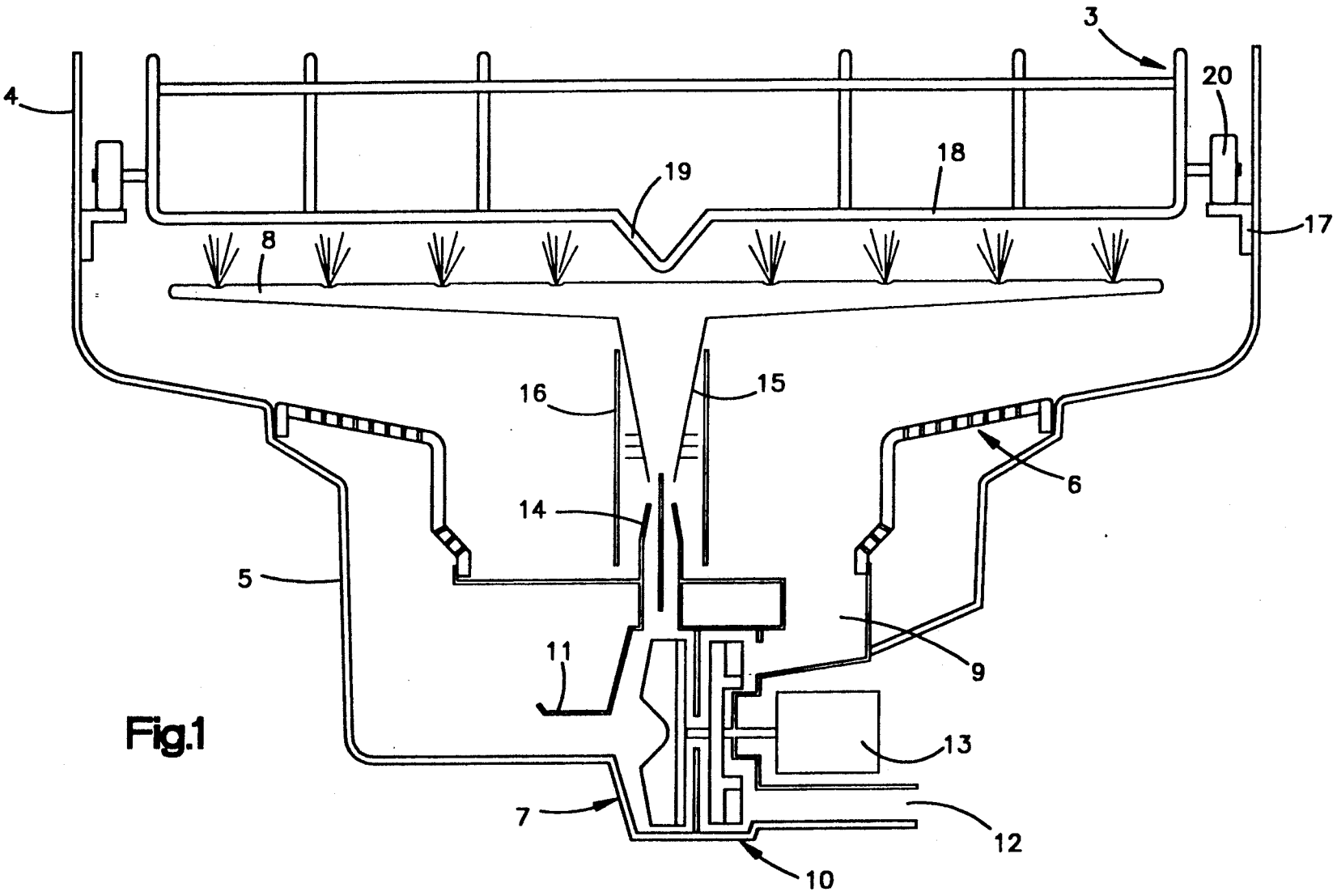
FIG. 1 shows schematically a partial cross section of a preferred construction of the dishwasher according to the invention; and, FIG. 2 shows schematically a view of a rack for the dishwasher in FIG. 1.

Referring to the drawing figures, the dishwasher consists mainly of a wash tub (4) (shown only partially in FIG. 1) fitted at the bottom with a filtering device, indicated generically by 6, and with a washwater collection well (5) with has a bottom in communication with the suction inlet (11) of the circulation pump (7), which is preferably of the centrifugal type. The pump is suitable to feed at least one rotor (8) to spray, in the familiar manner, the dishes supported by a rack (3), placed a short distance above the rotor.

The bottom of the wash tub (4) also communicates with the suction inlet (9) of a discharge pump (10), whose force or pressurized duct (12) is connected to a hydraulic drain duct (not shown). For example, pumps 7 and 10 are driven by a reversible electric motor (13) and are made as described in EP-A-0 268 835.

In the known manner, for example as described in the above mentioned GB-A-1 514 652, the rotor (8) is connected to the pumps (7) force or pressurized duct by a connection duct that extends upward from the bottom of the wash tub (4). In particular, the connection duct has a fixed lower tubular portion (14) which forms a hydraulic rotating joint with an upper tubular portion (15) firmly fixed to the rotor (8). The upper tubular portion (15) is inserted freely into a support and centering frame (16) that holds it in alignment with the lower tubular portion (14), with which it is substantially coupled.

Figure 2:
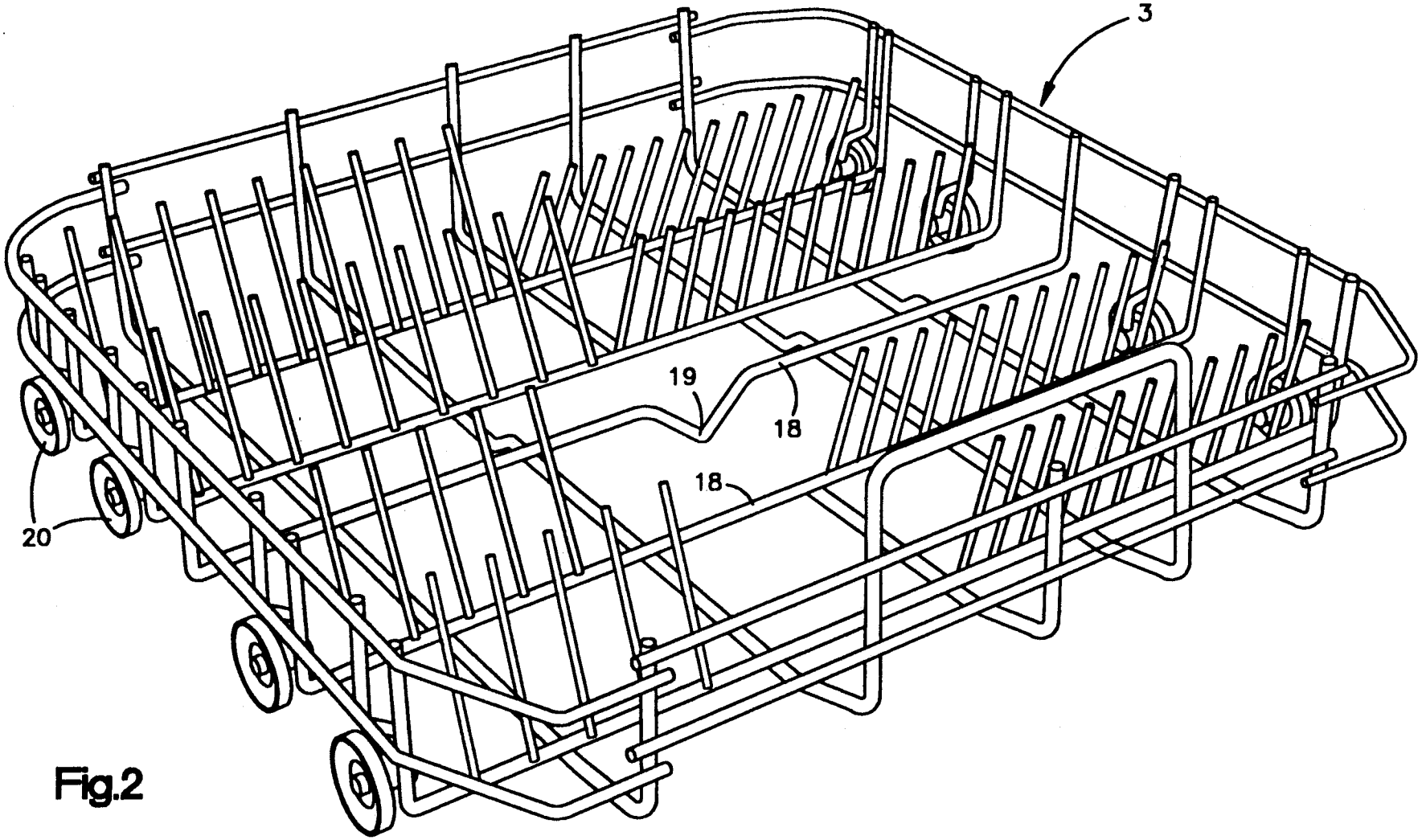

The rack (3) is supported in a removable fashion by traditional roller guides (17) and wheels (20) within the wash tub (4). As shown in FIG. 2, the rack (3) is preferably constituted by a support frame of plastic-covered wire, the bottom of which consists of a number of molded crosspieces (18). According to one feature of the present invention, the bottom of the removable rack (3) is equipped with stops which, when the rack is in operating position in the tub (4), are adjacent to and axially aligned with the rotor (8). It is preferred that such stops be made up of a molded central portion (19) of at least one of the racks intermediate crosspieces (18). In particular, the central portion (19) of the intermediate crosspiece (18) extends downward from the bottom of the rack (3) in the form of a V. The lower end of the molded part (19) is of a size such that there are several millimeters of play or space between it and the rotor (8), to allow the free withdrawal of the rack (3) from the wash tub when the machine is inoperative.

When the dishwashers operation is started, on the other hand, the hydraulic pressure in the circulation pump (7) tends to raise the rotor (8) axially, as already stated. At such times, vertical movement of the rotor (8) is limited by the racks molded part (19) or stop, against which the latter's lower end (substantially a point and thus advantageously devoid of friction with the rotor (8)) the rotor strikes. Of course, the rack (3) remains supported on the guides (17) by reason of its own weight and that of the dishes supported by it.

The simplicity of construction and the functionally handy nature of the dishwasher according to the invention is evident. In particular, the rotor (8) does not require any specific device to limit its vertical travel and is simply held by gravity in the support frame (16), from which it may be immediately removed for cleaning after having first withdrawn the rack (3) from the wash tub (4).

Obviously, the dishwasher described can undergo numerous alterations falling within the scope of the present invention. For example, the rack (3) can be shaped differently and/or be made of other materials. Moreover, it should be understood that at least one more support rack and associated rotor can be normally housed in the wash tub (4) above the rack (3).

I claim:

1. A dishwasher, comprising a wash tub in which is inserted at least one removable rack to support dishes; a water circulation pump; a rotor having a substantially vertical axis and being arranged below the rack to spray the dishes with water fed by the water circulation pump, a connection duct extending upwardly from the bottom of the tub with a fixed lower tubular portion forming a rotatable hydraulic joint with an upper tubular portion which is integral with the rotor to rotate therewith about a substantially vertical axis, said connection duct being arranged to direct water from the pump to the rotor, said rotor and said upper tubular portion being subject to upward travel when said pump is started; and downwardly protruding stop means (19) provided on the bottom of said rack (3), said stop means being substantially aligned with the axis of said rotor (8) and adjacent to the rotor when the rack is inserted in the tub (4), to limit the upward travel of the rotor (8).

2. A dishwasher according to claim 1, wherein the bottom of the rack comprises a plurality of crosspieces, and said stop means include a shaped central part (19) of at least one of said crosspieces (18).

3. A dishwasher according to claim 2, wherein said central part (19) has a substantially V-shaped configuration.

4. A dishwasher according to claim 1, wherein said upper tubular portion (15) is freely inserted in a support frame (16).

* * * * *